US006463704B1

(12) United States Patent
Jette

(10) Patent No.: US 6,463,704 B1
(45) Date of Patent: Oct. 15, 2002

(54) CABLE SUPPORT APPARATUS FOR A RAISED FLOOR SYSTEM

(76) Inventor: Roger Jette, 17 Prospect St., Babylon, NY (US) 11702

( * ) Notice: Subject to any disclaimer, the term of this patent is extended or adjusted under 35 U.S.C. 154(b) by 4 days.

(21) Appl. No.: 09/706,634

(22) Filed: Nov. 6, 2000

Related U.S. Application Data

(60) Provisional application No. 60/163,910, filed on Nov. 5, 1999.

(51) Int. Cl.[7] ..... E02D 35/00

(52) U.S. Cl. ..... 52/125.2; 52/126.6; 52/220.1

(58) Field of Search ..... 52/263, 220.5; 248/161, 405, 157, 676, 125.8

(56) References Cited

U.S. PATENT DOCUMENTS

| | | | | |
|---|---|---|---|---|
| 3,844,440 A | | 10/1974 | Hadfield et al. | |
| 4,593,499 A | | 6/1986 | Kobayashi et al. | |
| 4,596,095 A | | 6/1986 | Chalfant | |
| 4,612,746 A | | 9/1986 | Higgins | |
| 4,630,417 A | | 12/1986 | Collier | |
| 4,676,036 A | | 6/1987 | Bessert | |
| 4,850,162 A | | 7/1989 | Albrecht | |
| 5,049,700 A | | 9/1991 | Kobayashi et al. | |
| 5,389,737 A | | 2/1995 | Kobayashi et al. | |
| 5,412,914 A | | 5/1995 | Daw et al. | |
| 5,477,649 A | | 12/1995 | Bessert | |
| 5,546,717 A | | 8/1996 | Penczak et al. | |
| 5,548,932 A | | 8/1996 | Mead | |
| 5,628,157 A | | 5/1997 | Chen | |
| 5,953,870 A | * | 9/1999 | Jette | 52/220.1 |
| 6,101,768 A | * | 8/2000 | Springstead et al. | 52/126.6 |

FOREIGN PATENT DOCUMENTS

| | | |
|---|---|---|
| GB | 2 015 268 A | 9/1979 |
| WO | WO 90/10966 | 9/1990 |

* cited by examiner

*Primary Examiner*—Carl D. Friedman
*Assistant Examiner*—Steve Varner
(74) *Attorney, Agent, or Firm*—Carter, Deluca, Farrell & Schmidt, LLP

(57) ABSTRACT

A cable support apparatus for a raised floor system comprising at least one support member. The at least one support member is configured to be mounted to a pedestal of the raised floor system and connect with portions of cable trays. The support member, in one preferred embodiment includes a first member and a second member, each defining a slot for positioning on the support pedestal. The support member also includes a plurality of holes for the securing of the first member and the second member together as well as for connecting with cable trays. The cable trays are attached to the support member with an attachment mechanism such as a threaded stud.

21 Claims, 4 Drawing Sheets

CABLE SUPPORT APPARATUS FOR A RAISED FLOOR SYSTEM

This application claims the benefit of provisional application No. 60/163,910 filed Nov. 5, 1999.

CROSS REFERENCE TO RELATED APPLICATIONS

The present disclosure is related to applicant's prior U.S. Pat. No. 5,953,870 Raised Floor System and Cable Support Apparatus, filed Sep. 11, 1997, the entire contents of which are hereby incorporated by reference.

BACKGROUND

1. Technical Field

The present disclosure relates to an apparatus used with a raised floor system for providing a supporting structure for a cable management system and more particularly to a cable support apparatus which can be installed on a support pedestal of the raised floor system to provide structural support for the cable management system.

2. Description of the Related Art

Raised floor systems have been developed to provide the additional utility space needed in various different conduit or cable intensive environments where the original construction did not provide adequate means of accommodating the vast amount of conduit or cable. For example, probably the most common environment requiring vast amounts of additional protected space is for large computing systems. Such installations were typically made in facilities which simply were not designed to accommodate the vast amount of cable runs required to operate the typical large computer system. Other applications where additional utility space is required include mechanical systems, e.g., heating, ventilating and air conditioning systems.

A common problem experienced in utilizing raised floor systems is maintaining organization of the various cables, conduits, pipes, etc. which are routed beneath the floor system. One solution to this problem is to provide a cable tray system, cable management system, or cable pathway system beneath the floor panels of the raised floor to contain and direct cables along their respective pathways. An example of such a cable tray system is disclosed in U.S. Pat. No 4,596,095 which issued on Jun. 24, 1986 to Chalfant (the "'095 Chalfant Patent"). The '095 Chalfant Patent features a modular cable tray assembly which is formed from modular sections which include a number of different components all of which must be separately assembled to form the cable tray. For example, the cable tray includes separate straight sections, horizontal bend sections, horizontal tee sections, horizontal cross-intersection sections, as well as splice plates to connect the various components to each other as well as supporting the assembled cable tray above the building floor Such a cable tray assembly is, therefore, independent of the raised floor system.

One drawback of such a raised floor and cable support system is the additional labor required to assemble the various components of the separate raised floor and cable support systems. In geographic regions with particularly high labor rates, the cost of erecting such a labor intensive dual system could prove to be cost prohibitive.

Another drawback of such a system is that a manufacturer's raised floor system typically will only interrelate with and provide support for that manufacturer's cable support system. Thus, consumers are forced to retrofit or choose a less favorable system in one aspect, such as the raised floor system, over another aspect, such as the cable support system. In the alternative, independent cable support systems are procured which significantly add the overall costs because materials have to be procured for a separate independent cable support structure. These additional labor and material costs can significantly increase the overall cost of installing a complete cable support apparatus and raised floor system.

An alternative solution to supporting cable runs below a raised floor assembly is proposed in U.S. Pat. No. 5,548,932 which issued on Aug. 27,1996 to Mead (the "'932 Mead Patent"). The '932 Mead Patent features a height adjustable cable tray support system which includes a member of separate components which must be assembled to form the cable support system. Plates which support the cable tray are secured by welding or other methods to the pedestals of the exiting raised floor system featured in the '932 Mead Patent Additionally, support rods are required in the '932 Mead Patent cable tray support system, which support the cable tray on the support plates.

One disadvantage of such a system is the labor intensive nature of the installation In particular, each support plate must be separately secured to the floor system pedestals and the support rods and cable tray sections must be installed. This combined with the cost of the material components required for such a system can add significant cost to the installation of the complete system.

Accordingly, there is a continuing need for an improved cable support apparatus which utilizes a minimum number of components and is easier to adapt with and install on raised floor systems than existing systems In addition, there is a continuing need for an improved cable support apparatus that can adapt to and interface with a wide variety of cable management systems.

SUMMARY

A cable support apparatus for a raised floor system comprising at least one support member wherein each support member defines at least one slot for positioning on a support pedestal of a raised floor system. The support member being structurally supported by the support pedestal and the support member further defining a plurality of holes therein for the positioning and supporting of at least one cable basket In one preferred embodiment, the at least one support member includes a first member and a second member. Each member defines a slot configured and dimensioned to engage with the pedestal of the support member and defines at least two holes for connecting with cable trays.

The presently disclosed cable support apparatus, together with attendant advantages, will be best understood by reference to the following detailed description in conjunction with the figures below.

BRIEF DESCRIPTION OF THE DRAWINGS

Preferred embodiments of the presently disclosed cable support apparatus are described herein with reference to the drawings, wherein.

DETAILED DESCRIPTION OF THE PREFERRED EMBODIMENTS

Figure 1:
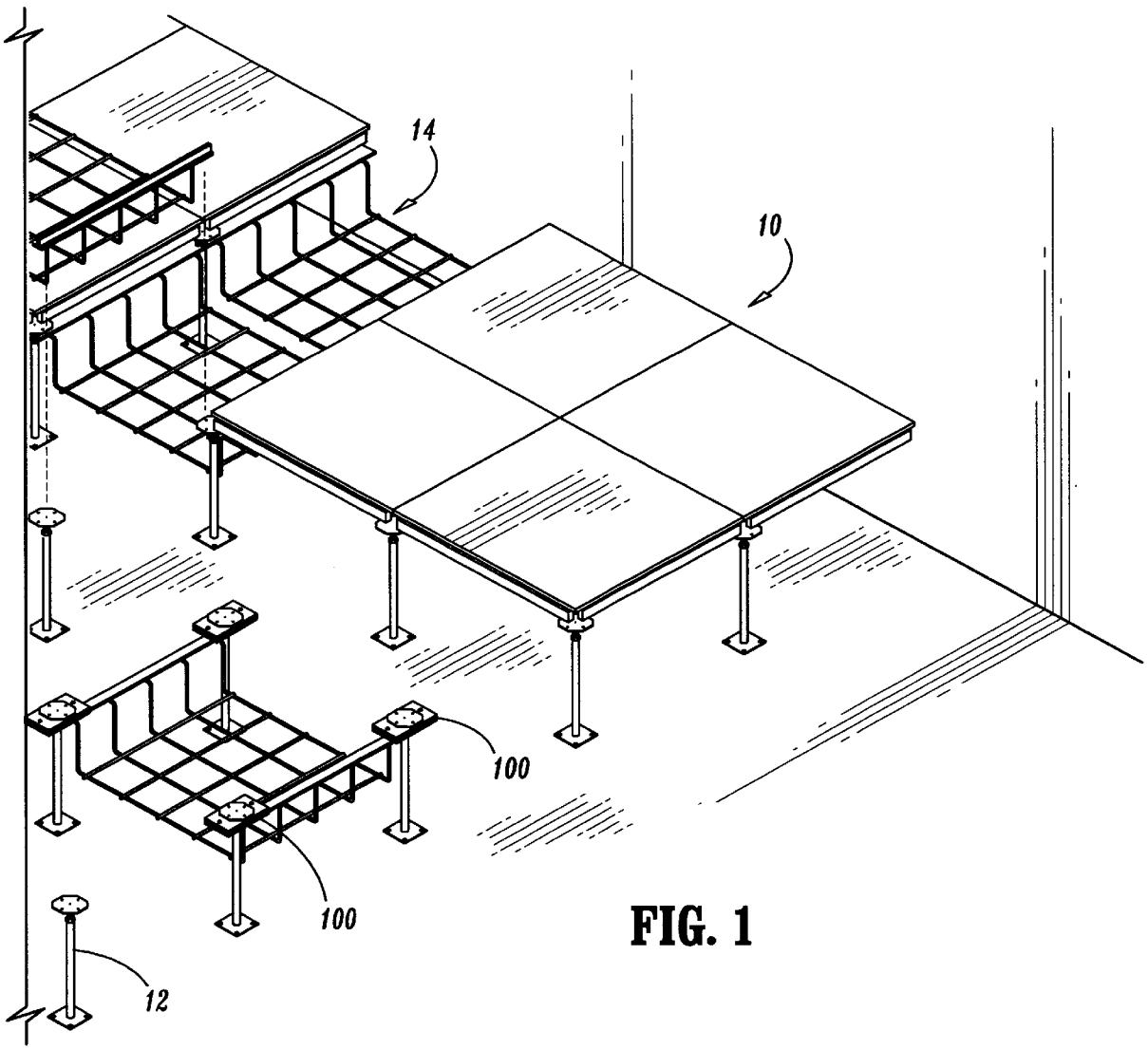
FIGS. 1 is a perspective view of a cable support apparatus installed with a raised floor system and supporting portions of a cable management system.

Referring to the drawings in detail, and initially to FIG. 1, the presently disclosed cable support apparatus for a raised floor system 100 (hereinafter referred to as the "support apparatus 100") is shown installed on a plurality of support pedestals 12 of a raised floor system 10. Support apparatus 100 is positioned to provide structural support for one or more portions of a cable management system or cable supporting pathways, such as cable baskets 14.

Figures 2A, 2B:
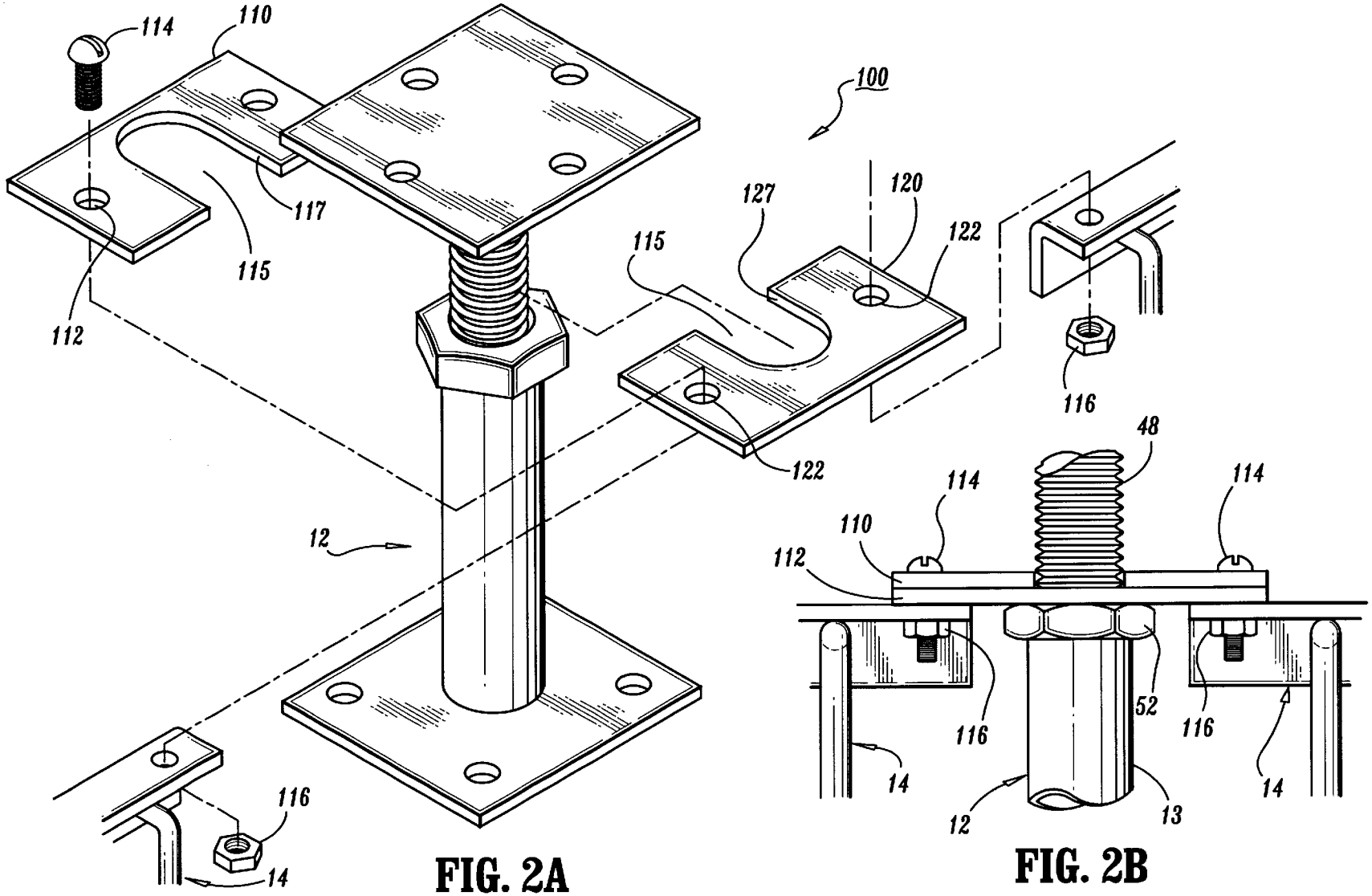
FIG. 2A is a perspective view of the cable support apparatus of FIG. 1 being installed on a support pedestal of one illusive raised floor system.
FIG. 2B is a perspective view of the cable support apparatus of FIG. 1 installed on the support pedestal and supporting two cable baskets.

In FIG. 2A, support apparatus 100 includes a first member 110 and a second member 120 [that are joined to form a hole 114 that engages with support pedestal 12 to form a structurally supporting member for cable baskets 14. When joined], with each member 110 and 120 including a pair of through-holes 112 and 122 respectively and a cut-out portion 117 and 127 respectively. When first and second members 10 and 120 are joined together, through-holes 112 and 122 are concentrically aligned and [provide a locking mechanism that engages] cut-out to portion 117 of first member 110 and cut-out portion 127 of second member 120 [to forms hole 114 that engages] with support pedestal 12. The inside of hole [114] 115 may have a lining or a bias that enhances its ability to engage support pedestal 12. Hardware common to those skilled in the art, such as [the] threaded bolts 114 and nuts 116, are installed in through holes 112 and 122 to interlock members 110 and 120 together and against support pedestal 12.

Referring now to FIG. 2B, support apparatus 100 is shown installed onto support pedestal 12 and supporting two cable baskets 14. Threaded bolts 114 connect first member 110, second member 120, and cable basket 14. First member 110 and second member 120 are fabricated from common material, e.g. sheet metal stock and are fully capable of handling typical cable runs similar to that of U.S. Pat. No. 5,953,870. While a support apparatus 100 is shown taking the form of two identical sheet metal members, it can take any geometric form, such as a bar or a pair of bars with a central capture mechanism, that interlocks around support pedestal 12 and provides through holes 112,122 for attaching cable baskets 14. support apparatus 100 is preferably configured to attach to support pedestal 12 on treaded stud 48. Support apparatus 100 can be configured to rest on nut 52, or for example, [or] provide vertical support through its locking mechanism with threaded stud 48 or stanchion 13.

Figure 2C:
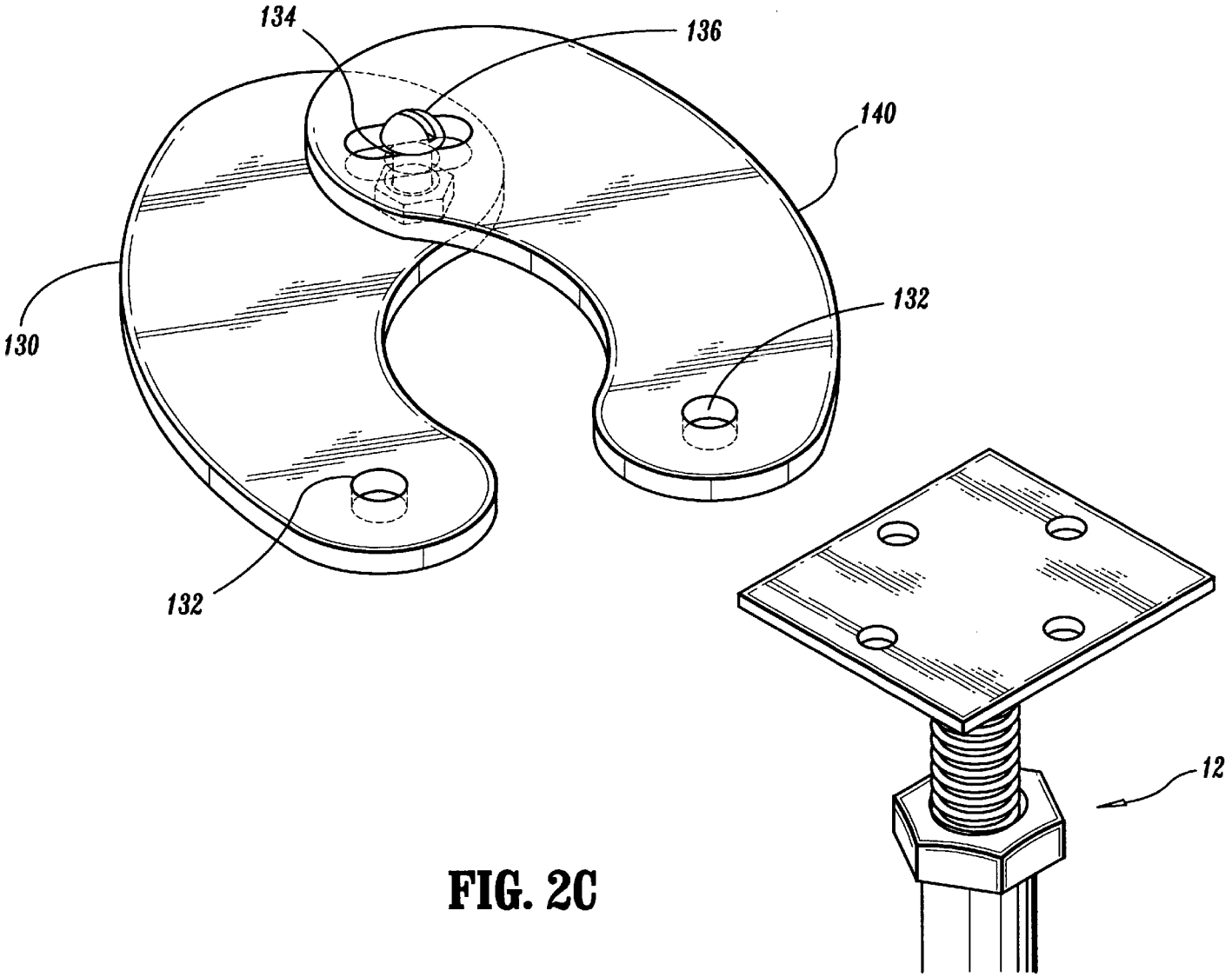
FIG. 2C is a perspective view of one alternative embodiment of the cable support apparatus of FIG. 1 being installed on the support pedestal.

In FIG. 2C, an alternative configuration of support apparatus 100 is shown with a first member 130 and a second member 140 connected together pivotally, for example, [using a through hole 132 or a slot 134 to provide notation] by a bolt 136 passing through a pair of coaligned slots 134 formed in an end thereof, thereby providing movement and rotation of first and second members 130 and 140 to one another. In this configuration, first member 130 and second member 140 are installed around support pedestal 12 and then interlocked [using the second through hole] by coaligning through holes 132 formed near an opposite end of each member 130 and 140 and passing a bolt (not shown) thereof through.

Figure 2D:
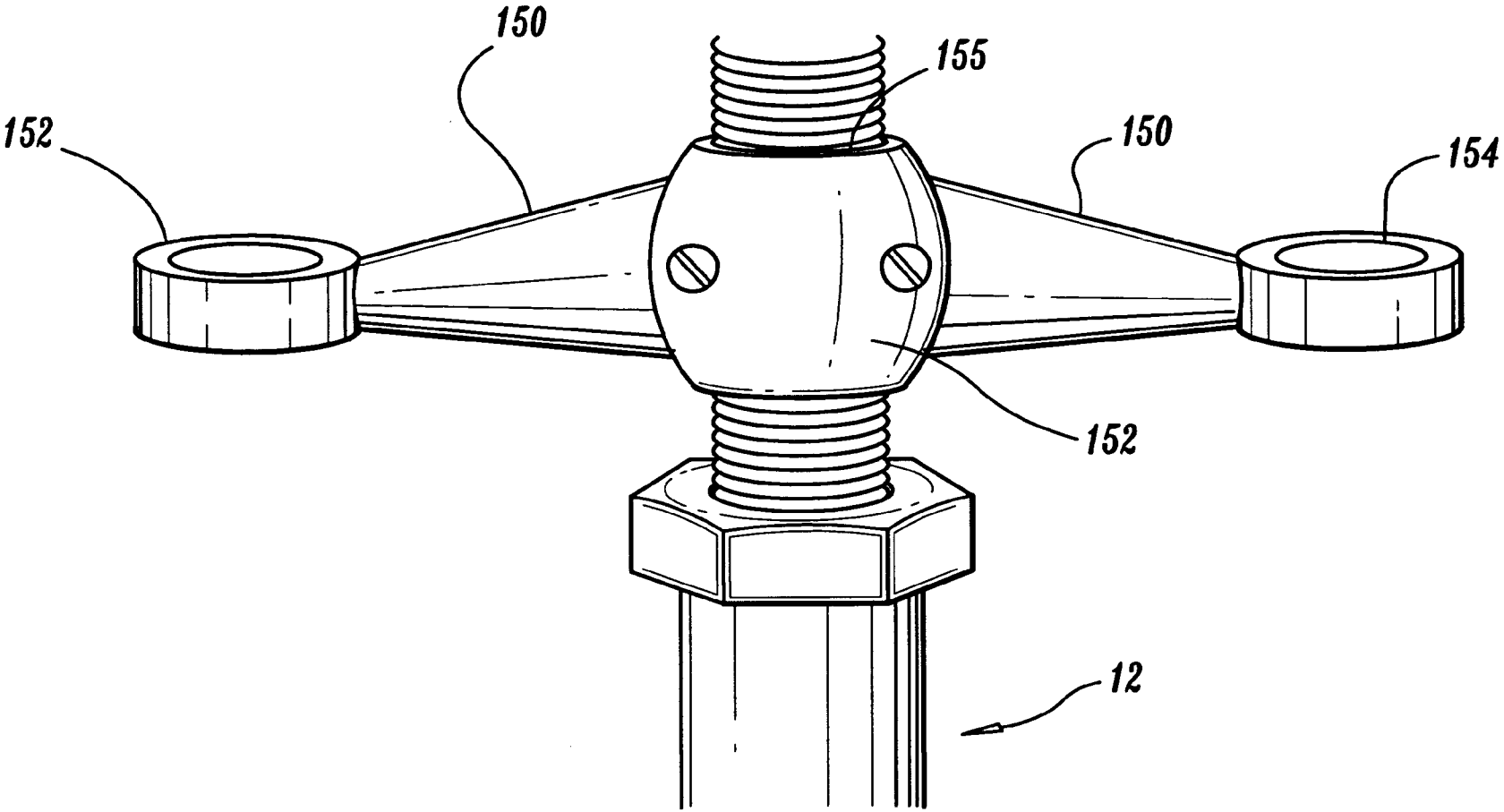
FIG. 2D is a perspective view of an additional embodiment of the cable support apparatus using an attachment mechanism at the support pedestal as constructed in accordance with the present disclosure.

Referring now to FIG. 2D, an additional alternative configuration of support apparatus 100 is shown with a first member [140] 150 that forms a hole [145] 155 that attaches to pedestal support 12 using a frictional latching or mechanical mechanism [142] 152 that directly engages support pedestal 12. Through holes [142 and 144] 152 and 154 are positioned to provide attachment points for cable baskets 14.

Support apparatus 100 is also configurable to include varying quantities of through holes or alternative attachment mechanisms that support up to four typical cable baskets 14. Additional support apparatus 100 configurations could, for example, support additional quantities of cable baskets 14 configurations such as crossing intersections or "T" type baskets. Alternative configurations of support apparatus 100 that support varying quantities of cable baskets 14 are also envisioned that include different geometric forms, pivot mechanisms, or a mechanism that captures and locks on support pedestal 12.

Although illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the disclosure, All such changes and modifications are intended to be included within the scope of the disclosure.

What is claimed is:

1. A cable support apparatus for mounting with a raised floor system and connecting with at least a portion of a cable management system comprising:

at least one support member having a first member connected with a second member, the first member and the second member being configured and dimensioned for coupling with a support pedestal of a raised floor system and for supporting a portion of at least one cable basket of a cable management system thereon wherein the first member and second member are slidingly engageable and positionable around the support pedestal.

2. The cable support apparatus of claim 1, wherein at least one of the first and second members is configured and dimensioned as a planar element.

3. The cable support apparatus of claim 1, wherein the first and second members are planar elements which overlap when positioned around the support pedestal.

4. The cable support apparatus of claim 3, wherein the first and second members arc metal plates.

5. A cable support apparatus for mounting with a raised floor system and connecting with at least a portion of a cable management system comprising:

at least one support member having a first member connected with a second member, the first member and the second member being configured and dimensioned for coupling with a support pedestal of a raised floor system. and for supporting a portion of at least one cable basket of a cable management system thereon, wherein the first member and the second member are rotatingly connected and positionable around the pedestal.

6. The cable support apparatus of claim 5, wherein a pin is positioned in a first hole defined by the first member and in a first hole defined by the second member to thereby pivotally engage the first member to the second member.

7. The cable support apparatus of claim 6, wherein the first member defines a second hole and the second member defines a second hole and the first member and the second member are connected together around the pedestal using the second hole in the first member and the second hole in the second member.

8. The cable support apparatus of claim 5, wherein the first and second members are planar elements which overlap when positioned around the support pedestal.

9. The cable support apparatus of claim 8, wherein the first and second members are metal plates.

10. The cable support apparatus of claim 5, wherein at least one of the first and second members is configured and dimensioned as a planar element.

11. A modular cable support system for use in a raised floor system, which comprises:

a plurality of support members each being adapted to attach to a portion of a support pedestal of a raised floor system at a vertical displacement below the height of a raised floor parcel of the raised floor system which is supported by a plurality of support pedestals of the raised floor system; and a plurality of modular cable support baskets configured and dimensioned to be supported by the plurality of support members so as to form a cable support pathway beneath the floor panels, wherein each of the plurality of cable support baskets are configured and dimensioned to have a length and width which is less than that of an opening formed when a floor panel of the raised floor system is removed to facilitate passage of one of the plurality of cable support baskets through the opening to be supported by the plurality of support members.

12. The modular floor system according to claim 11, wherein the plurality of support members attach to the support pedestals by frictional latching thereto.

13. The modular floor system according to claim 11 wherein upon installation in conjunction with the raised floor system, each of the plurality of modular cable support baskets is disposed vertically beneath a corresponding floor panel of the raised floor system.

14. The modular cable support system according to claim 13, wherein each of the plurality of modulate support baskets is supported by four of the plurality of support members.

15. The cable support apparatus of claim 11, wherein the plurality of support members include planar elements.

16. The cable support apparatus of claim 11, wherein each of the plurality of support members includes first and second planar members which overlap when positioned around the support pedestal.

17. The cable support apparatus of claim 16, wherein the first and second planar members are metal plates.

18. A method of installing a cable support pathway in a raised floor system, comprising the steps of:

attaching a plurality of support members to a plurality of support pedestals at a vertical displacement below the height of a series of raised floor panels of the raised floor system; and resting a cable support basket on a portion of the plurality of support members to form a cable pathway below the height of the floor panels of the raised floor system, wherein the cable support basket is configured and dimensioned to have a length and width which is less than that of an opening formed when a floor panel of the raised floor system is removed.

19. The method according to claim 18, wherein the step of attaching a plurality of support members includes attaching a single support member to each one of four of the plurality of support members.

20. The method according to claim 18, wherein the step of resting a cable support basket includes resting the cable support basket such that the basket is supported a distance below the height of the raised floor panels by the four of the plurality of support members.

21. The method according to claim 18, wherein the steps of attaching a plurality of support members is repeated and the step of resting a cable basket is repeated.

* * * * *